US005317883A

United States Patent [19]

Newman

[11] Patent Number: 5,317,883

[45] Date of Patent: * Jun. 7, 1994

[54] APPARATUS AND METHOD FOR QUICKLY COOLING SPECIMENS AND SUBSTANCES WITHIN REFRIGERATION SYSTEMS

[76] Inventor: Arnold L. Newman, 8220 Hamilton Spring Ct., Bethesda, Md. 20817-2714

[ * ] Notice: The portion of the term of this patent subsequent to May 4, 2010 has been disclaimed.

[21] Appl. No.: 55,318

[22] Filed: May 3, 1993

Related U.S. Application Data

[63] Continuation-in-part of Ser. No. 754,623, Sep. 4, 1991, Pat. No. 5,207,762.

[51] Int. Cl.[5] ..... F25B 41/00

[52] U.S. Cl. ..... 62/419; 62/62

[58] Field of Search ..... 62/62, 404, 405, 417, 62/419, 457.1, 457.4

[56] References Cited

U.S. PATENT DOCUMENTS

| | | | |
|---|---|---|---|
| 3,998,072 | 12/1976 | Shaw | 62/457.4 |
| 4,358,932 | 11/1982 | Helfrich, Jr. | 62/419 X |
| 4,468,932 | 9/1984 | Bullard | 62/457.1 X |
| 4,485,641 | 12/1984 | Angelier et al. | 62/419 X |
| 4,681,611 | 7/1987 | Bohner | 62/457.4 X |

*Primary Examiner*—John C. Fox

[57] ABSTRACT

This invention relates to an apparatus and method for increasing the cooling rate of an item and its contents within a refrigeration system. The item is supported in a housing that also includes a motor driven fan. The apparatus containing the item to be cooled is placed in a refrigeration system and the motor driven fan moves cold air from the refrigeration system through the housing, thereby quickly and favorably cooling the item. An important use of the apparatus and method is for quickly cooling scientific and medical specimens and substances.

15 Claims, 2 Drawing Sheets

APPARATUS AND METHOD FOR QUICKLY COOLING SPECIMENS AND SUBSTANCES WITHIN REFRIGERATION SYSTEMS

CROSS-REFERENCE TO RELATED APPLICATION

This is a continuation-in-part of patent application Ser. No. 07/754,623, filed on Sep. 4, 1991, now U.S. Pat. No. 5,207,762.

BACKGROUND OF THE INVENTION

1. Field of the Invention

This invention relates to an apparatus and method for cooling specimens and substances within refrigeration systems. In particular, this apparatus and method favorably decrease the temperature of a specimen or substance quicker than the refrigeration system can alone.

2. Description of the Related Art

U.S. Pat. No. 4,030,314 discloses a method and apparatus for preserving biological materials that provide a coolant to a cooling chamber within which air is continuously circulated. This system uses its own coolant in a freezing chamber, and is not itself for use within a separate refrigerant system.

U.S. Pat. No. 4,485,641 discloses a device for freezing biological products that uses a liquid gas such as liquid nitrogen within a container in which a biological specimen is supported. This patent specifies the use of a motor, external to the container, that drives an impeller, within the container, by means of a communicating shaft. The impeller circulates vapors from the liquid gas coolant throughout the cooling system.

U.S. Pat. No. 5,111,664 discloses a portable refrigerating/heating apparatus in which the cooling means is a Peltier heat exchanging unit integral with the apparatus itself. Because the apparatus produces its own cold air, it is self-contained and not dependent on the cold air of a separate refrigeration system such as a freezer, refrigerator or cooler.

In the art of cooling biological samples, several laboratory devices are available for bench top use. For example, several products have metallic blocks, which receive and hold test tubes and other laboratory containers, sometimes in association with a freezing gel, that are precooled and then used on the laboratory bench to keep reagents, enzymes, and other materials cold, yet conveniently available.

OBJECTS OF THE INVENTION

An object of the present invention is to increase the cooling rate of specimens or substances when they are placed in a refrigerator, freezer, cooler or the like.

A further object of the present invention is to cool specimens or substances in a refrigeration system more efficiently and quickly than if the refrigeration system itself were solely relied upon to cool the item. Cooling of such specimens or substances occurs so that a phase change can be effected where, for example, a liquid is frozen to its solid state, or biological material is frozen.

Another object of the present invention is to cool directly and controllably an item for a particular time or duration within a cooling chamber. Such a time or duration can be directly measured as with a control timer or clock, or indirectly, by causing the cooling process to progress to the point where the specimen or substance achieves a phase change as when a liquid, below its freezing point, turns to a solid. Thus, it is also an object of this invention to speed the cooling rate of a specimen or substance within a cooling chamber so that it can become frozen faster than if it were merely placed in the cooling chamber without benefit of this invention.

An additional object of the invention is to provide an indication of when an item has been cooled for a predetermined amount of time or to a predetermined temperature.

SUMMARY OF THE INVENTION

There is a need to quickly cool specimens and substances in refrigeration systems. In particular, there is a need for an apparatus and method that, when used in conjunction with a refrigeration system, will more favorably and quickly cool specimens and substances. For example, blood specimens and other bodily materials derived from patients for diagnostic or scientific purposes are often frozen to retard biological activity (e.g., enzyme activity) and to preserve the nature and material content of the specimen in advance of performing assays and other diagnostic tests, or for general storage purposes. Sometimes, such materials are even transported in the frozen state to central laboratories. It is useful to freeze such specimens quickly to limit changes due to degradation or biological and chemical action. Although this can be done with cryogenic systems, these systems are often expensive to obtain, difficult to operate, and pose a danger to the user. Furthermore, users of cryogenic systems must be trained to use such sophisticated equipment. It is thus advantageous and desirable to have a portable apparatus for use within a refrigeration system to increase the cooling rate of a specimen or substance to cool or even freeze such a material more quickly than would otherwise occur just by putting the specimen or substance in the refrigerator. For the purposes of this patent, the word portable, in addition to its usual definition, means that the apparatus can be easily placed in and removed from a variety of refrigeration systems. Thus the apparatus, and thus, its housing is designed for removable placement within a refrigeration system. The apparatus of this invention cools specimens and substances quicker and more favorably than if these materials were placed in the refrigeration system without the apparatus. In addition to cooling specimens and substances for diagnostic purposes, there are many other important applications and uses of this invention. For example, in research laboratories, it is often desirable to stop a chemical reaction quickly by cooling, but without using ice, particularly if the reactants of the chemical system react violently with water or ice. The present invention accommodates trays of substances, racks of test tubes and other scientific containers and laboratory ware of various types, so as to cool the contents of these racks or containers more quickly. For the consumer, the present invention is useful in cooling items of domestic use and consumption. An example of a domestic application of the present invention is the quick cooling of water within an ice cube tray to make ice cubes. Domestic uses in particular relate to other cooling applications such as are found in the kitchen and elsewhere in the home.

For the purposes of this patent, the term item, in addition to its usual sense, means a container and the contents contained therein. These contents can be solid, liquid, or even gaseous, as well as mixtures thereof. For example, blood samples, while containing mostly liquid, also have solid components such as blood cells of various types and crystalline precipitates. Indeed, sometimes the process of cooling a mixture causes the components of the mixture to separate by precipitation or some other phenomena. Furthermore, cooling certain mixtures sometimes causes their components to combine to a greater degree. For example, the ability of most gases to dissolve in water increases as temperature decreases.

The apparatus of the present invention uses the cold air of a refrigeration system to favorably and quickly cool specimens and substances. It concentrates the cooling power of the refrigeration system by focusing and directing a stream or flow of cold air from the refrigeration system against items and thus makes better and more efficient use of the cold air for cooling specimens and substances. In particular, it is a portable apparatus that receives and holds the specimen or substance to be cooled as well its container within which it is placed. The apparatus blows and circulates cold air so that the specimen or substance and the container in which it is placed are contacted by the blown cold air. In most cases the specimen or substance is held in a tube or other container which is supported within the apparatus of the invention by a support, such as a test tube rack, stand, or a tray, which the apparatus of the invention is designed to receive and hold. Because of the movement of the cold air through the apparatus, air contacting the specimen or substance is continually refreshed, and the temperature of the air contacting the specimen or substance and the container and support structure is kept as close to the average temperature of the air within the refrigeration system as possible. The apparatus supplements and enhances the cooling action of a refrigeration system. For example, it is not convenient or sufficient to place a specimen or substance to be cooled in the path of moving air from the integral fan inlet into the cooling compartment of a refrigeration system. This air stream will not be focused or directed against a specific container of specimens or substances, and, if the refrigeration system is full of other items, it could be blocked. Furthermore, refrigeration systems go through different cycles, including defrost cycles.

In the present invention a motor driven fan is used for moving the cold air and an on/off switch is provided. The specimen or substance to be cooled is held within the apparatus, most often within a container that is supported within the apparatus by a support such as a rack, stand, or tray. There are a variety of ways in which this is done. For example, the housing is designed to receive a rack, stand, or tray in which containers of material such as specimens or substances are held. These racks and trays can be of a variety of materials including metallic or other heat conducting material or non-metallic, non-heat conducting material. It is important, however, that the apparatus optimally cools the specimen or substance contained within a container. This can be best achieved by choosing materials for the construction of the apparatus whose heat capacities allow them to cool down quickly without interfering with the optimal cooling of the specimen or substance. Materials for fabricating this apparatus are also chosen with an economic consideration. For example, materials might be chosen that are typically used in the fabrication of laboratory ware or kitchen ware. Supports, such as racks or trays, maintain the specimens and substances and associated containers to be cooled in a spaced relationship with the inner surface of the housing. This configuration allows the free movement and circulation of air both around and against the item to be cooled such as a specimen or substance within its associated container supported within the rack, stand, or tray, as well as around and against such supports, and the inner surface of the housing. With this apparatus a container and its contents are cooled directly by cold air contacting its surface. They are also cooled by loss of heat by conduction through the supports with which the container's surface and thus, effectively, its contents are in contact. These elements, including the supports, are themselves cooled by contact with the cold, moving air. These elements can also be touching, contacting, or attached to the housing (which is itself contacted by the cold, moving air) and as such, benefit from the housing's ability to dissipate heat. The supports can be an integral part of the housing, or be removable. Removable supports such as test tube racks can be used successively with the apparatus, and thus, over time, a plurality of test tube racks and their associated test tubes and contents therein can be quickly cooled. Each rack or other item, after being quickly cooled, can be removed from the device and stored in the refrigeration system to make way for the next test tube rack or item to be cooled. The apparatus can be configured to accommodate more than one rack, stand, or other support. Other configurations can directly accommodate containers themselves. For example microtiter plates (e.g., 96 well plates, etc.), commonly used in laboratories, and ice cube trays can be received by the apparatus so as to more quickly cool the containers and their contents. Other containers contemplated for use with this apparatus, but with which it is by no means limited to, include centrifuge and microcentrifuge tubes, ELISA and assay plates, vials, culture tubes, and the like.

By quickly cooling water, the apparatus of the present invention is used to make ice and ice cubes quickly and efficiently. In this application, water is put directly into the housing, which is configured as an ice or ice cube tray. Cold air from the refrigeration system is blown and circulated by the motor driven fan within the housing, and around and against the water to be frozen and the tray in which it is held.

The apparatus of the present invention can also provide for temperature sensing and timing. An alarm can alert the user when the process is complete as determined either by elapsed time, temperature or both. Cooling can be allowed to progress to freezing of the material or item, or it can be stopped before freezing occurs. When the apparatus provides such sensing capability, it has the necessary associated electronics, which are known in the art, to support such functions. The fan speed can be varied according to the desired rate of cooling. This can be done automatically by the electronic control system in association with sensing functions, or it can be set manually. The electronics can include a microprocessor or microcontroller.

DETAILED DESCRIPTION OF THE PREFERRED EMBODIMENTS

Figure 1:
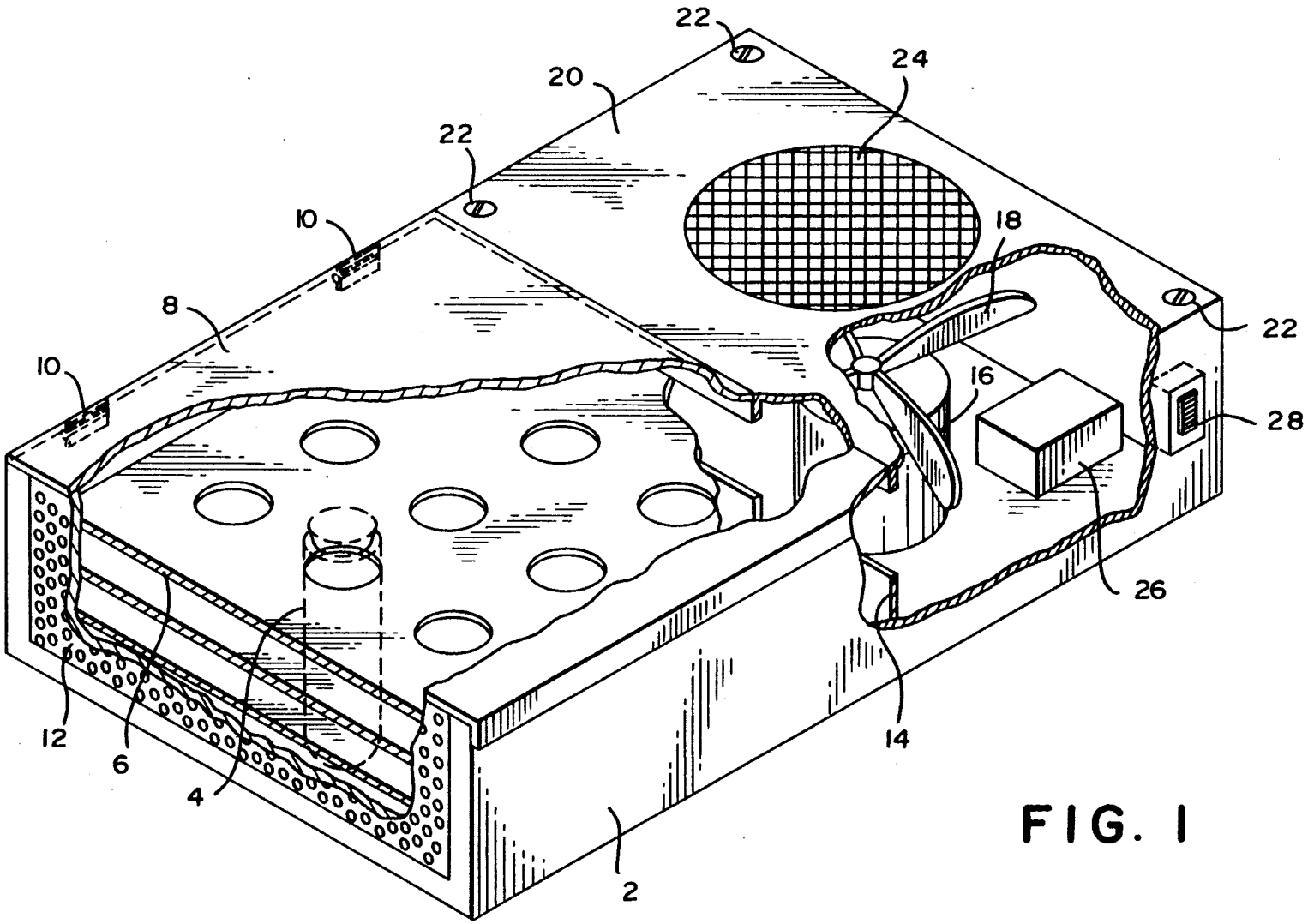
FIG. 1 is a cut away perspective view illustrating the present invention.

A major use of the apparatus and method of the present invention is to cool items within refrigeration systems more quickly than they would cool if they were simply placed in the refrigeration system without benefit of the present invention. An important use of the invention is to cool or freeze scientific and medical specimens and samples quickly, although there are also many other applications. In FIG. 1, housing 2 is shown as the enclosing structure of the apparatus. The item to be cooled, for purposes of illustration, is test tube 4, which is held in a spaced relationship with the inner surface of housing 2 by rack 6. Rack 6, in the preferred embodiment, is removable so that multiple racks of items such as test tubes can be cooled or frozen successively. A rack of test tubes, after being more quickly frozen through the use of the apparatus of this invention within a refrigeration system, could be kept frozen within the same or a different refrigeration system. Rack 6 can be put into or removed from housing 2 by opening cover 8, which is attached to the housing with hinges 10. Air screen 12, which is porous to airflow, is shown on the side of the apparatus and allows a free flow of air into or out of housing 2. Housing 2 is provided with fluid barrier 14, which partitions the space within the housing between a space that receives a rack, and a space that contains electrical and mechanical elements. The purpose of fluid barrier 14 is to prevent fluid or other materials, perhaps due to an inadvertent spill, from contaminating or otherwise interfering with the operation of the electrical and mechanical elements of the apparatus. As shown, fluid barrier 14 is a wall, integral with housing 2, which rises partly from the floor of housing 2, thus preserving the free flow of air through the apparatus. Fan 16 includes propeller fan blade 18, and is preferably an electric fan. As shown, the section of the apparatus within which fan 16 is contained, is covered by top plate 20, which is secured to housing 2 by screws 22. Top plate screen 24, which is porous to airflow, is shown in top plate 20, and is aligned with propeller fan blade 18 to minimize resistance to the free flow of air into or out of housing 2. In operation, fan 16 and propeller fan blade 18 cooperate to move cold air from within a refrigeration system into and then out of housing 2. Airflow is such that it passes through rack 6 and contacts test tube 4, thereby more quickly cooling test tube 4 and its contents. In the embodiment of FIG. 1, for example, fan 16 can operate to push air out housing 2 through top plate screen 24. Cold air from within a refrigeration system within which the apparatus is placed thus moves into housing 2 through air screen 12 and contacts the material to be cooled, which, as shown, is test tube 4 and its contents held in rack 6. Electronics module 26 contains power and control electronics for operating fan 16, and for providing temperature sensing and timing functions. Switch 28 is used to turn the apparatus on and off. The design and operation of such functions is well known in the electronics art.

Figure 2:
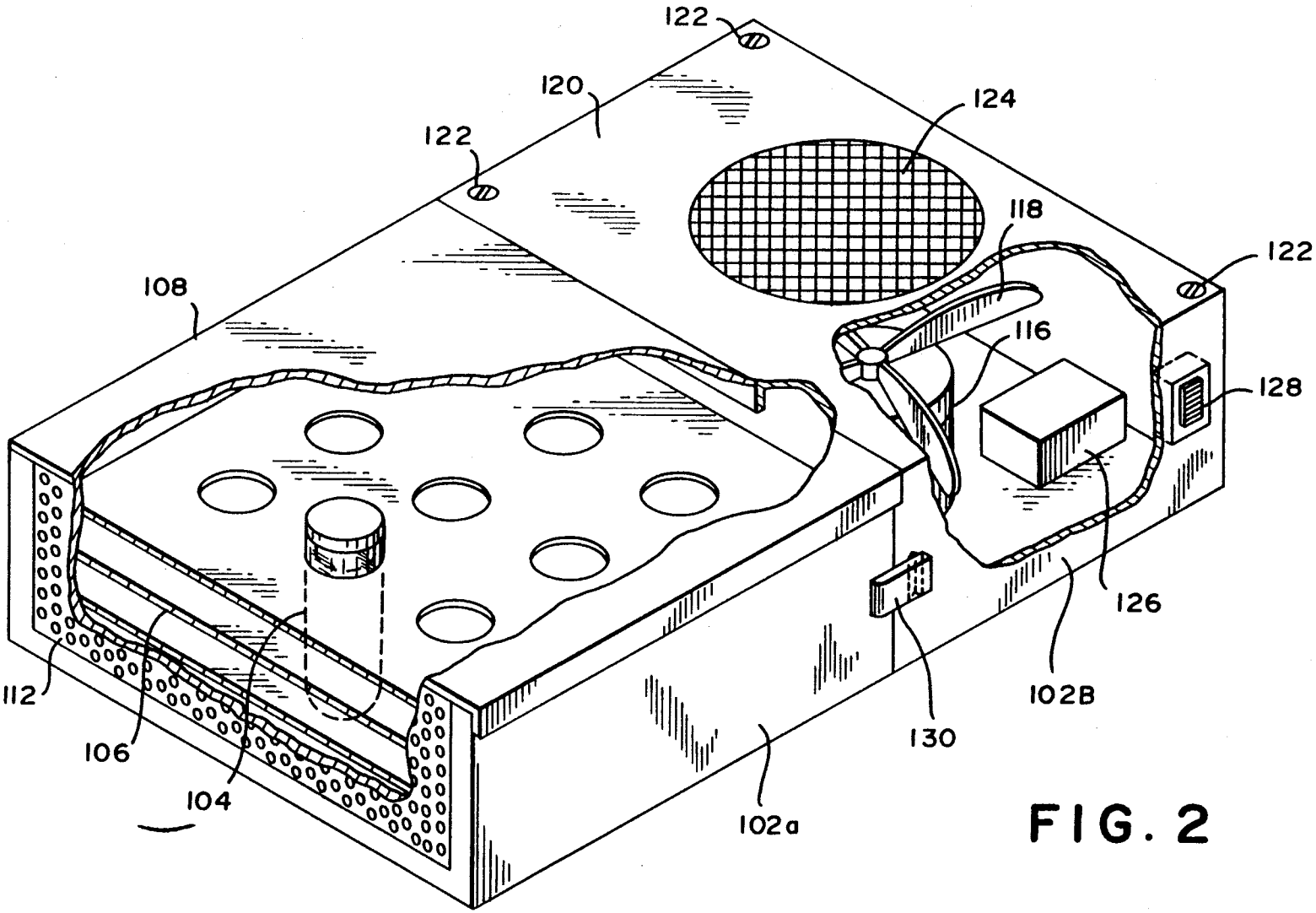
FIG. 2 is cut away perspective view of another embodiment of the apparatus in accordance with this invention.

FIG. 2 illustrates an alternative embodiment of the invention. In this embodiment the housing is comprised of two detachable housing sections shown as **102*a* and 102*b*. As shown, housing section 102*a* holds or receives a rack 106, which is shown supporting test tube 104. Housing section 102*b* is detachably connected, joined, coupled, or engaged to housing section 102*a* by section connector 130. The configuration of this embodiment allows the use of a plurality housing sections, such as housing section 102*a*, that can be successively used with housing section 102*b*. Cover 108 covers housing section 102*a* and is fitted thereon by a light compression fit. It is easily lifted to allow access to the contents of housing section 102*a*. Air screen 112 allows air to pass into or out of the housing because it is made of a porous material such as a screen or solid material with holes therethrough. Housing section 102*b* contains electrical and mechanical components associated with moving cold air through the housing from the refrigeration system as well as other functions such as timing and temperature measurement or sensing. Housing section 102*b* is covered by top plate 120, which is secured to housing section 102*b* by screws 122. Top plate screen 124 is framed by top plate 120 and it allows the movement of cold air from within the refrigeration system to pass into or out of the housing of the apparatus. Top plate screen 124 is aligned with propeller fan blade 118, which is connected to and driven by fan 116 to allow a minimal resistance to airflow into or out of the housing of the apparatus. Electronics module 126 contains all the necessary electronics to operate the apparatus, including functions associated with power and control, and timing and temperature measurement. The design and operation of such functions is well known in the electronics art. Switch 128 is for turning the apparatus on and off. Additionally, switch 128** can be supplemented in the electronics module with an electronic cut-off switch that turns off the fan when a particular temperature has been reached.

The particular elements of the embodiments are given as examples only. Variations of these elements are useful within the scope of the present invention.

In another version, the sectional configuration embodiment of FIG. 2 is a stacked structure. Here, for example, a housing section for holding or containing the fan and associated electronics engages, couples or connects to one or more sections that are adapted to receive racks or trays of items to be cooled. The configuration allows a stacking, or "piggy-backed" arrangement where one fan section moves air through one or more stacked rack or tray containing sections. In this case the fan section can be at any place in the stack of sections. If the fan section is placed on the top, however, there is no danger of liquid spilling onto the fan or other electrical or mechanical elements associated with the movement of cold air. It is important that the various stacked, detachable sections be in airflow communication so that air can flow into the housing, contact the various components to be cooled, and flow out of the housing.

In still another configuration, a miniature tubular housing is designed to receive at least one test tube or similar item. A miniature fan pulls or pushes air up or down through the space between the inner surface of the housing and the item to be cooled. This configuration can be unitary, or sectional, and can be small enough to be worn like a pen, with a clip for holding it in a pocket, on a member within a refrigeration system, or the like.

For this invention, a variety of fans known in the art can be used for moving cold air. For example, the propeller fan blade 118 and fan 116 can be used to move cold air in or out the top plate screen 24 of FIG. 1 or 124 of FIG. 2. Centrifugal blower fans, impeller fans, and axial fans as well as others in general are all applicable for air moving purposes of this invention.

The apparatus of the invention can accommodate a large variety of items for cooling. For example, in addition to test tube racks, the apparatus can cool 96 well plates (also known as mictrotiter plates) commonly used in molecular biology. Additionally, ice cube trays, racks of centrifuge tubes, electrophoresis gels, and metallic blocks used to cool tubes at the laboratory bench can be accommodated.

An additional feature that can be incorporated into the apparatus is the use of a means to treat the cold air moving through the housing of the apparatus. For example, a deodorizer can be placed in series with the path of moving air. Such a deodorizer could be, for example, a porous activated charcoal structure, or a filter impregnated with bicarbonate of soda, both of which are known to have deodorizing properties. Deodorizing is useful in the making of ice cubes, to avoid imparting an undesirable taste to the ice from odors in the refrigeration system. Another example of an air treatment means is silica gel impregnated in a material or contained within a porous pouch. This functions to remove moisture from the air flowing through it, particularly if it is placed in series with the direction of airflow. This prevents the build-up of frost on specimens and the like.

The apparatus of the invention is powered by batteries, or it can be powered from a power outlet specifically provided therefor within the refrigeration apparatus. Alternatively, the apparatus is powered through an AC power line or cord designed to pass through the door seal or an opening of a refrigeration system. In this case, the cord is simply plugged into a power outlet outside the refrigeration apparatus.

The apparatus cools one, or more than one, rack, tray or other support structure. Furthermore, it can be configured to have a fixed rack or tray unitary and integrated with the housing, or it can be provide a space specifically designed to receive and hold a variety of different racks. This configuration is useful, for example, when racks accommodating different sized test tubes are used.

The invention described is not intended to be limited to the embodiments disclosed but includes modifications made within the true spirit and scope of the invention.

I claim:

1. An apparatus for portable use within a refrigeration system for increasing the cooling rate of an item comprising:

(a) a housing for removable placement within said refrigeration system for receiving and holding said item therein in at least partially spaced relationship with at least part of the inner surface of said housing;

(b) a fan positioned in conjunction with said housing for moving cold air from said refrigeration system through said housing said cold air contacting said item.

2. The apparatus as recited in claim 1 wherein said item comprises a container and its contents.

3. The apparatus as recited in claim 2 wherein said container is a microtiter tray.

4. The apparatus as recited in claim 2 wherein said container is an ice cube tray.

5. The apparatus as recited in claim 1 further comprising a support contacting said inner surface of said housing for receiving and holding said item and defining said spaced relationship between said item and said inner surface and wherein said item is contacted by said moving cold air and is thereby cooled.

6. The apparatus as recited in claim 5 wherein said housing is comprised of at least two detachable sections connected in airflow communication, wherein a first section contains said fan, and wherein at least a second section contains said support.

7. The apparatus as recited in claim 5 wherein the support is a part of the inner surface of said housing itself.

8. The apparatus as recited in claim 5 wherein said support comprises at least one rack, removable from said housing, adapted for holding at least one of said item

9. The apparatus as recited in claim 1 wherein said item comprises at least one material within at least one container.

10. The apparatus as recited in claim 1 further comprising at least one temperature sensor for indicating when an item has attained a selected temperature

11. The apparatus as recited in claim 1 further comprising a timer alarm for indicating a preset period of cooling.

12. A method for increasing the cooling rate of an item within a refrigeration system, comprising the steps of:

(a) placing into said refrigeration system said item and its contents in a portable housing having a fan and at least one support adapted to receive and contact said item;

(b) Moving cold air from said refrigeration system against said item by use of said fan thereby cooling said item and its contents;

(c) removing said item and said housing from said refrigeration system.

13. The method as recited in claim 12 further comprising the step of providing a temperature sensor for indicating a selected temperature.

14. The method as recited in claim 12 further comprising the step of providing a timer alarm for indicating a preset period of cooling.

15. A portable apparatus for use within a refrigeration system for increasing the cooling rate of an item comprising:

(a) a housing for removable placement within said refrigeration system, said housing having an inner surface;

(b) at least one support contacting said inner surface of said housing for receiving and holding said item and defining an at least partially spaced relationship between said item and said inner surface;

(c) a fan positioned in conjunction with said housing for moving cold air from said refrigeration system through said housing, said cold air contacting and thereby cooling said item.

* * * * *